US011011337B2

(12) United States Patent
Gay et al.

(10) Patent No.: US 11,011,337 B2
(45) Date of Patent: May 18, 2021

(54) FAST SPIN-POLARIZED ELECTRON SOURCE

(71) Applicant: NUtech Ventures, Lincoln, NE (US)

(72) Inventors: Timothy J. Gay, Lincoln, NE (US); Herman Batelaan, Lincoln, NE (US); Evan Brunkow, Lincoln, NE (US); Eric Jones, Lincoln, NE (US)

(73) Assignee: NUtech Ventures, Lincoln, NE (US)

( * ) Notice: Subject to any disclaimer, the term of this patent is extended or adjusted under 35 U.S.C. 154(b) by 0 days.

(21) Appl. No.: 16/688,544

(22) Filed: Nov. 19, 2019

(65) Prior Publication Data

US 2020/0161072 A1 May 21, 2020

Related U.S. Application Data

(60) Provisional application No. 62/769,356, filed on Nov. 19, 2018.

(51) Int. Cl.
*H01J 1/34* (2006.01)

(52) U.S. Cl.
CPC ..... *H01J 1/34* (2013.01); *H01J 2201/3423* (2013.01)

(58) Field of Classification Search
None
See application file for complete search history.

(56) References Cited

U.S. PATENT DOCUMENTS 9,482,691 B1 * 11/2016 Ukhanov ..... G01Q 20/04
2010/0028707 A1 * 2/2010 Cowan ..... H05H 1/24 428/587
2010/0294958 A1 * 11/2010 Hayashi ..... H05G 2/006 250/504 R
2013/0228695 A1 * 9/2013 Mizoguchi ..... G03F 7/70175 250/372

FOREIGN PATENT DOCUMENTS

JP 11108610 A * 4/1999
WO PCT/CH2006/000367 A1 1/2007

OTHER PUBLICATIONS

Clayburn et al., "A cylindrically symmetric "micro-Mott" electron polarimeter," Review of Scientific Instruments 87, 053302 (2016), AIP Publishing, May 6, 2016.

* cited by examiner

*Primary Examiner* — Vip Patel
(74) *Attorney, Agent, or Firm* — Leydig, Voit & Mayer, Ltd.; Gerald T. Gray

(57) ABSTRACT

Systems and methods for obtaining fast, spin-polarized electrons from an edge or tip or cusp of a target material, e.g., a sharp GaAs crystal edge or tip, or a cusp, which naturally incorporates optical reversibility. A source of fast spin-polarized electrons may include a target material including a sharp tip or tip portion or a sharp edge or a cusp, the tip or tip portion including at least two intersecting edges, and a pulsed light source configured to emit one or more light pulses focused on the sharp tip or tip portion or the sharp edge or the cusp to thereby induce emission of spin-polarized electrons from the sharp tip or tip portion or the sharp edge or the cusp of the target material.

28 Claims, 6 Drawing Sheets

FAST SPIN-POLARIZED ELECTRON SOURCE

CROSS-REFERENCE TO RELATED DISCLOSURES

This application claims priority to U.S. Provisional Patent Application No. 62/769,356, filed on Nov. 19, 2018, which is hereby incorporated by reference in its entirety.

FEDERALLY SPONSORED RESEARCH OR DEVELOPMENT

This invention was made with Government support under contract numbers PHY1505794, PHY1206067, IIA1430519 and PHY1306565 awarded by The National Science Foundation. The Government has certain rights in this invention.

BACKGROUND

Pulses of electrons produced when femtosecond light pulses strike metal nanotips have been shown to be "fast", i.e. they have temporal widths comparable to those of the laser pulses that produce the pulsed electrons. These sources of pulsed electrons can be used in a variety of applications involving ultrafast time scales, including electron diffraction, electron microscopy, scanning tunneling microscopy, and electron crystallography. The temporal resolution of such experiments is limited by the duration of the electron pulse, which can be determined using laser pump-probe techniques.

Separately, experiments with spin-polarized electrons have made notable contributions to many disciplines, including atomic and molecular physics, high energy physics, and solid state physics. The standard polarized electron source uses a GaAs photocathode that has been layered with Cs and $O_2$ to lower the vacuum potential below that of the conduction band. This creates a "negative electron affinity" (NEA) condition that allows the electrons to be emitted by absorbing a single photon from a CW laser (see, e.g., FIG. 1, panel (a)). When circularly-polarized light with an energy near the bandgap of GaAs is used to excite the electrons, there is an imbalance in excitation probabilities of the two excited $^2s_{1/2}$ states (see, e.g., FIG. 1, panel (c)). This causes the emitted electrons to be spin-polarized. In addition to being an unmodulated source of polarized electrons, which eliminates the possibility of its use in time-resolved experiments, the drawbacks of the CW method include stringent vacuum requirements (typically $10^{-10}$ Torr or better) and practical limitations on targets used in spin-polarized electron collision experiments.

Other continuous sources for spin-polarized electrons have been developed, including iron-coated and cobalt-coated tungsten tips and a pulsed source of spin-polarized electrons from NEA bulk GaAsP with pulse durations of 16 ps. While these tip sources have the potential to provide both spin-polarized and fast pulsed electrons, optical reversal of the spin polarization, a highly desirable feature, is problematic.

SUMMARY

Embodiments of the present invention provide systems and methods for producing pulses of spin-polarized electrons. According to various embodiments, laser pulses are used to initiate the emission of spin-polarized electrons. The nonlinear nature of electron photoemission when induced by pulsed light, e.g., femtosecond pulsed light, advantageously eliminates the need for the production of NEA surfaces, while at the same time providing a fast time structure for the emitted electrons.

Certain embodiments provide systems and methods for obtaining fast, spin-polarized electrons from an edge or tip or cusp of a target material, e.g., a sharp GaAs crystal edge or tip, or a cusp, which naturally incorporates optical reversibility. In one embodiment, a source of fast spin-polarized electrons includes a target material including a sharp tip or tip portion or a sharp edge or a cusp, the tip or tip portion including at least two intersecting edges, and a pulsed light source configured to emit one or more light pulses focused on the sharp tip or tip portion or the sharp edge or the cusp to thereby induce emission of spin-polarized electrons from the sharp tip or tip portion or the sharp edge or the cusp of the target material.

According to an embodiment, a method of generating fast spin-polarized electrons is provided. The method typically includes providing a target material including a sharp tip or a sharp edge or a cusp, the sharp tip including at least two intersecting edges, and focusing one or more pulse from a pulsed light source onto the sharp tip or the sharp edge or the cusp, thereby inducing emission of spin-polarized electrons from the sharp tip or the sharp edge or the cusp of the target material.

According to another embodiment, a source of fast spin-polarized electrons is provided that includes a substrate including a plurality of sharp tips or cusps including a target material, each of said sharp tips including at least two intersecting edges, and a pulsed light source configured to emit one or more light pulses focused on the plurality of sharp tips or cusps to thereby induce emission of spin-polarized electrons from the plurality of sharp tips or cusps. The plurality of tips or cusps may be arranged in a rectilinear array.

According to yet another embodiment, a method of generating fast spin-polarized electrons is provided. The method typically includes providing a substrate including a plurality of sharp tips or cusps including a target material, each sharp tip including at least two intersecting edges, and focusing one or more pulses from a pulsed light source onto the plurality of sharp tips, thereby inducing emission of spin-polarized electrons from the sharp tip or the sharp edge of the target material. The plurality of tips or cusps may be arranged in a rectilinear array.

In certain aspects, the target material comprises GaAs, ZnSe, or GaAsP, or GaAs doped with Zn or Cd. In certain aspects, the pulsed light source includes a pulsed laser. In certain aspects, the pulsed light source includes a pulsed laser that emits laser pulses each having a duration of between about 10 fs and about 0.1 ps. In certain aspects, the pulsed light source includes a pulsed laser that emits laser pulses having a wavelength of between about 750 nm to about 850 nm or lower. In certain aspects, each of the laser pulses has a wavelength of about 800 nm. In certain aspects, the emission of spin-polarized electrons includes pulses having a duration of between about 10 fs and about 0.1 ps. In certain aspects, the emission of spin-polarized electrons includes pulses having a duration of about 350 fs. In certain aspects, the target material includes a non-negative electron affinity surface.

Reference to the remaining portions of the specification, including the drawings and claims, will realize other features and advantages of the present invention. Further features and advantages of the present invention, as well as the structure and operation of various embodiments of the present invention, are described in detail below with respect to the accompanying drawings. In the drawings, like reference numbers indicate identical or functionally similar elements.

BRIEF DESCRIPTION OF THE SEVERAL VIEWS OF THE DRAWING(S)

FIG. 1 is a simplified diagram of GaAs energy level structure for both negative electron affinity (NEA) and non-NEA surfaces. Both show the band bending of both the valance band (VB) and conduction band (CB) at the surface due to the standard heavy p-doping. Panel (a) shows the vacuum energy is lowered due to Cs and O2 deposition on the surface with (inset) a simple picture of the layering of Cs (green) and O2 (orange) on the GaAs (blue). Single photon emission is also shown. Panel (b) shows GaAs with no layering on the surface (inset) and the multiphoton absorption needed to surmount the vacuum energy. Panel (c) shows selection rules for the absorption of circularly-polarized light (Δmj=+1) and the relative line strengths (indicated in circles) yield a conduction-band electron polarization of (3−1)/(3+1)=50% for valance-conduction band resonant transitions.

FIG. 2 shows intensity of electron emission as a function of incident laser power on the GaAs tip. The data are fit well by a form R=aI5, where R is the electron current, a is a constant, and I is the laser intensity.

FIG. 3 shows additivity as a function of time delay between adjacent laser pulses. The "additive signal," A, is defined to be A=(I(1+2)−I1−I2)/(I1+I2), where the single-subscripted intensities, Ij, refer to the electron number emitted for individual pulses, where I(1+2) refers to the total electron emission due to the temporally-adjacent pulses combined. If A=0, the process is "additive," which implies that the electron emission process is fast.

DETAILED DESCRIPTION

The present embodiments provide systems and methods for obtaining fast, spin-polarized electrons from an edge or tip or cusp of a target material, e.g., a sharp GaAs crystal edge or tip, or a cusp, which naturally incorporates optical reversibility. In one embodiment, a source of fast spin-polarized electrons includes a target material comprising a sharp tip or tip portion or a sharp edge or a cusp, the tip or tip portion including at least two intersecting edges, and a pulsed light source that emits light pulses focused on the sharp tip or the sharp edge or the cusp to thereby induce emission of spin-polarized electrons from the sharp tip or the sharp edge or the cusp of the target material. In an embodiment, the target material includes a GaAs crystal configured with an edge or a tip structure. Other useful target materials might include Zn-doped GaAs, Cd-doped GaAs, GaAsP, MBE-strained GaAs, ZnSe, or other III-V materials or II-VI materials. In certain embodiments, the source includes a pulsed laser such as a Ti:Sapphire laser or HeNe laser, or any laser or radiation source with optical components configured to create laser or radiation pulses of desired duration(s) and wavelength(s).

Figure 1:
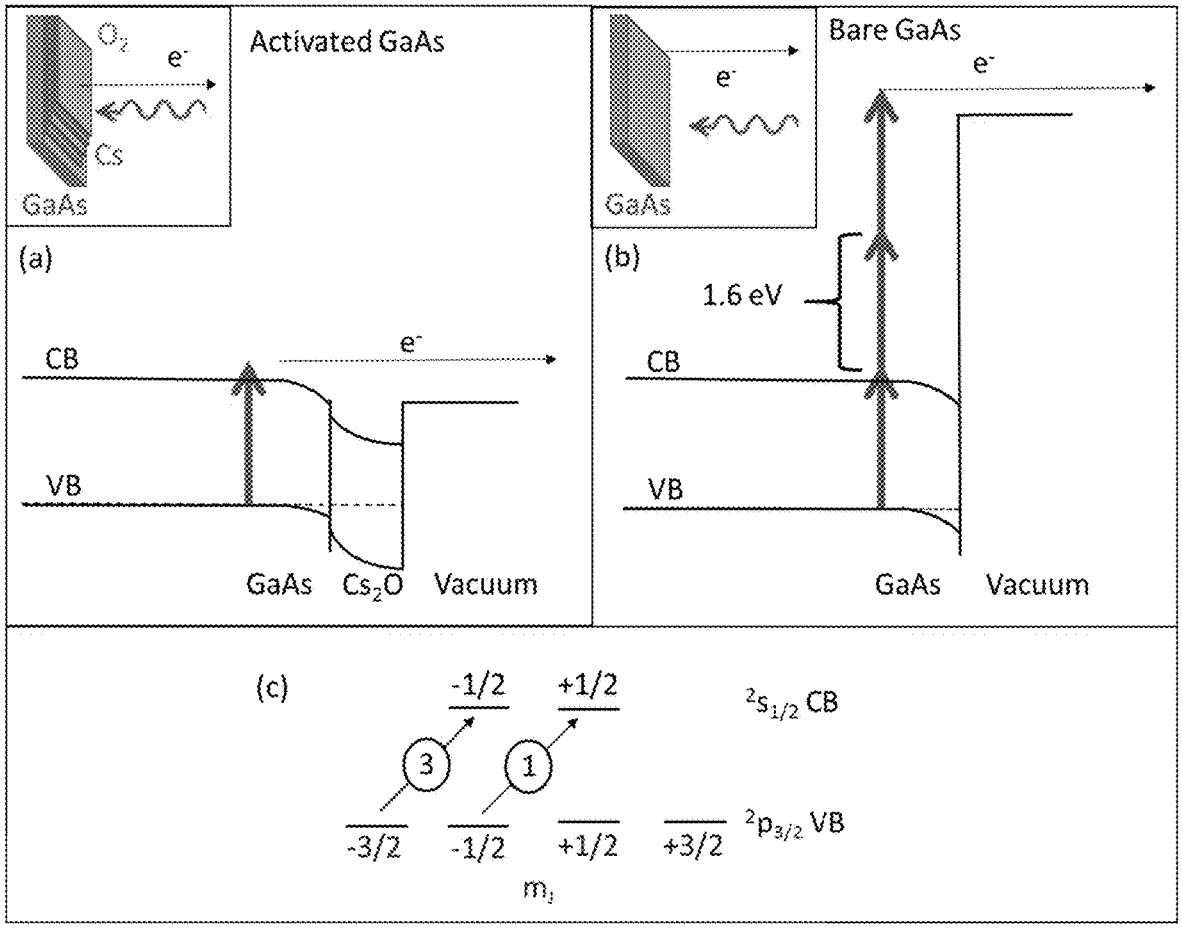

For example, in certain aspects, a laser such as a Ti:Sapphire pulsed laser with a wavelength centered around 800 nm (e.g., centered between about 750 nm to about 850 nm or lower), an appropriate wavelength for single-photon excitation across the band gap of GaAs, is used to induce electron emissions through multiphoton absorption while taking advantage of the relative excitation probabilities of a GaAs source (see, e.g., FIG. 1, panel (c)). After passing through the conduction band state, corresponding to single photon absorption, the emission can proceed either (i) through direct above-threshold ionization, or (ii) tunneling through the bulk-vacuum interface that has been altered in the presence of the intense laser field: multiphoton photo-field emission.

Devices according to certain embodiments produce short pulses of electrons (e.g., ~10 fs to ~0.1 ps in duration) that are spin-polarized, i.e., the spins of the individual electrons in the pulse are mutually aligned. In one particular embodiment, for example, electron pulses are produced when intense pulses of laser light (e.g., ~75 fs in duration; 1 nJ per pulse, 800 nm center wavelength) are focused onto the edge or tip of a shard of GaAs which is heavily Zn-doped (e.g., on the order of ~1% of the total mass of the crystal).

Experiments with spin-polarized electrons have made notable contributions to many disciplines in fundamental and applied physics, but state-of-the-art sources of spin-polarized electrons have very stringent vacuum requirements and are not pulsed. These two properties, of spin polarization and very short, pulsed time structure, have not been combined before; spin-polarized electron sources according to the present embodiments advantageously provide these properties. The spin-polarized electron sources according to the present embodiments have the ancillary benefit that vacuum technology and general operating requirements are modest, meaning that such technology is readily transferable to a variety of labs that have heretofore lacked the expertise to work with polarized electrons.

Figure 2:
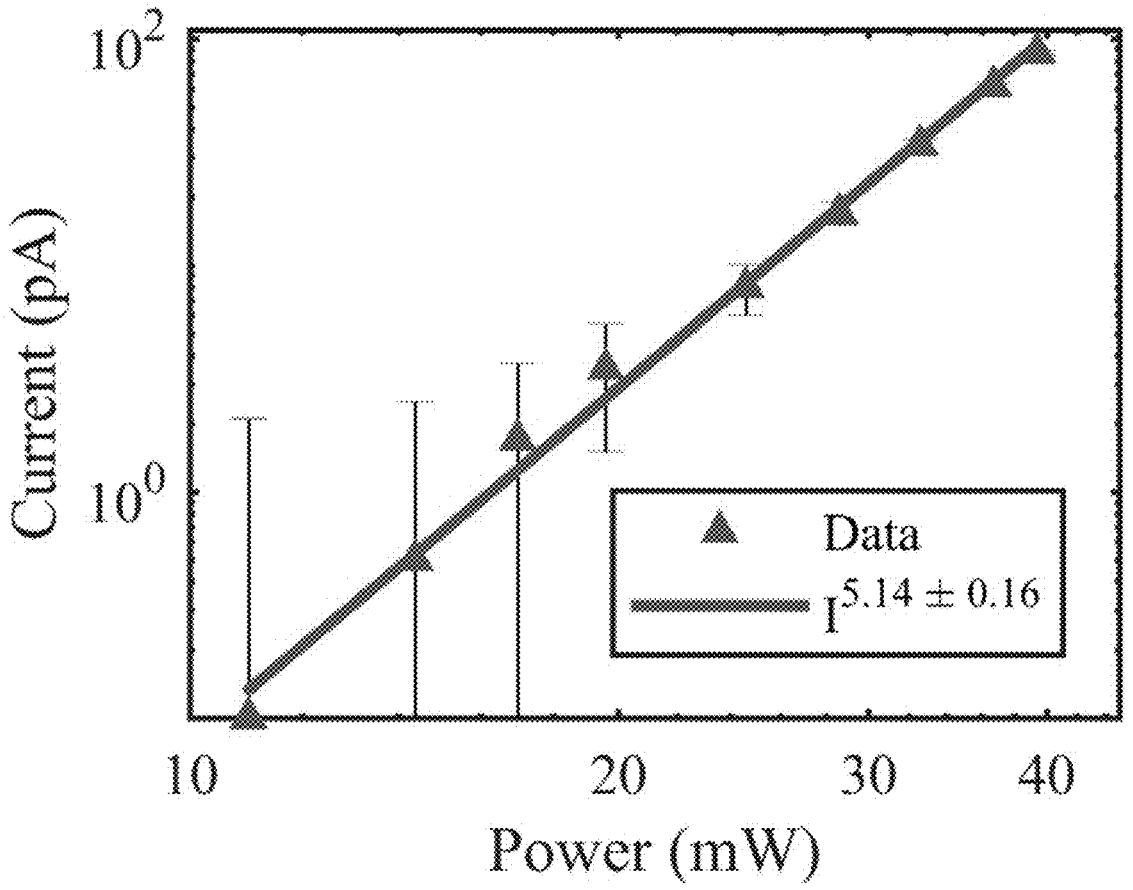
Figure 3:
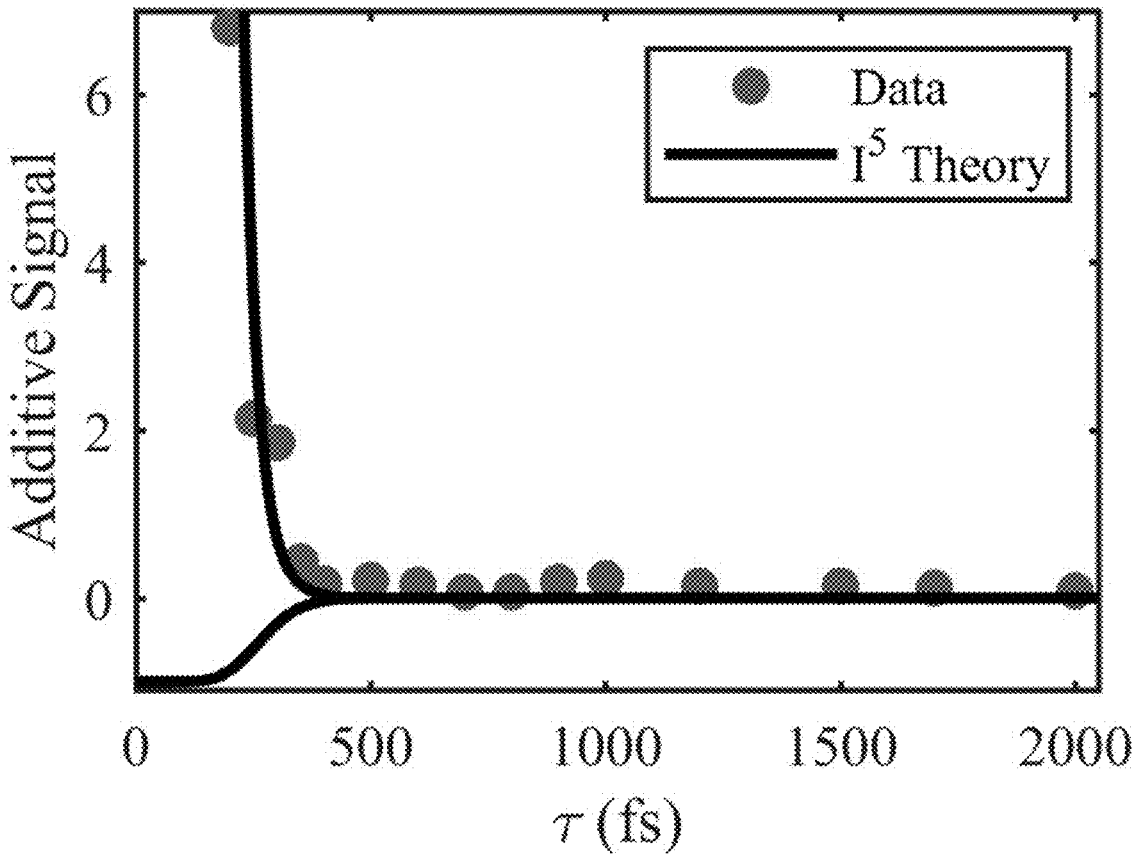
Figure 4:
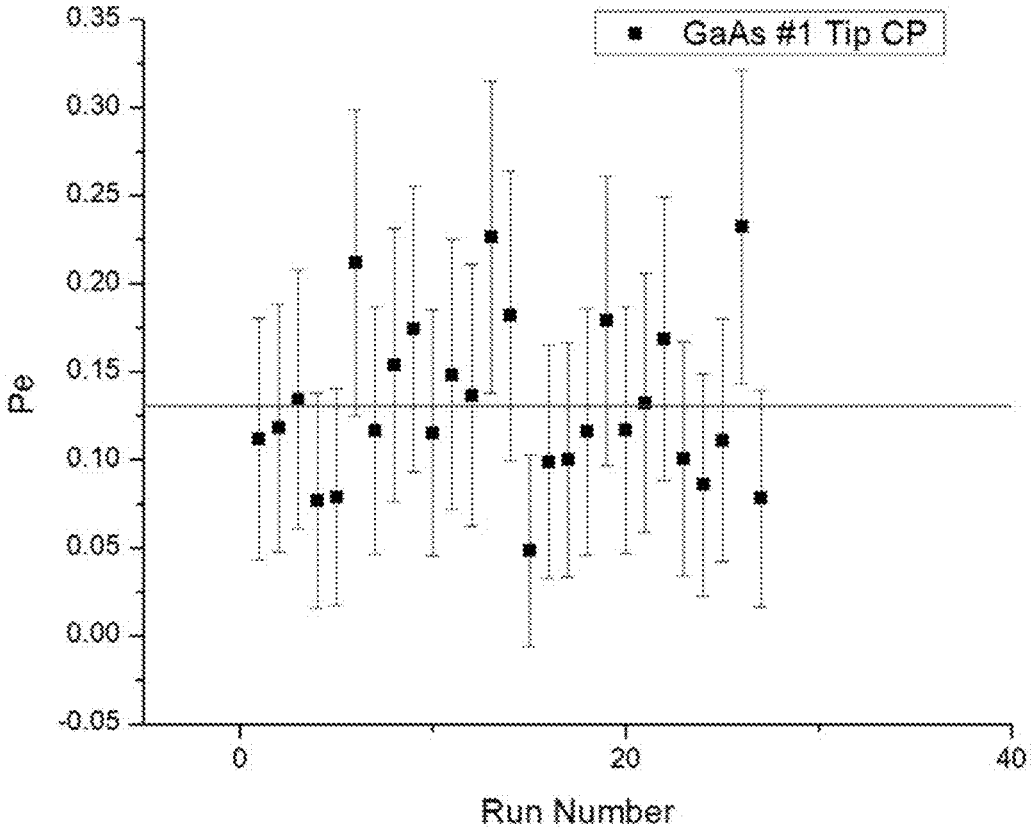
FIG. 4 shows polarization of electrons ($P_e$) emitted for 10 minute runs. The average polarization is 13.1%, corresponding to ~57% of the electrons being "spin-up" and 43% being "spin down."

Data showing that the emission from GaAs tips is fast (i.e. the emissions have temporal widths comparable to those of the laser pulses that produce the emissions) are shown in FIG. 2 and FIG. 3. When two temporally-separated short light pulses hit the sample, the emission can be categorized as either "additive" or "super-additive". Additivity implies that the emission for two sequential pulses is the same as the sum of the emission from each pulse individually. Super-additivity occurs when the emission from the combination of sequential beams is greater than the sum of the emission of the individual beams. Additive emission shows that the emission is fast. FIG. 2 shows that the emission of electrons is non-linear, because it increases as the fifth power of the laser's intensity. The fact that the electron pulses are fast (i.e., comparable in temporal duration to that of the laser pulses) is demonstrated by the fact that the emission is "additive" (FIG. 3). This means that when two pulses are directed at the GaAs with a short time delay, the sum of the electrons emitted by the two pulses equals that observed for two pulses with a very long time delay. The electron polarization for emission from a GaAs tip is shown in FIG. 4. The average current of the electron pulses being emitted in this experiment is about 2 nA and, as indicated, the average electron polarization is about 13%.

Figure 5:
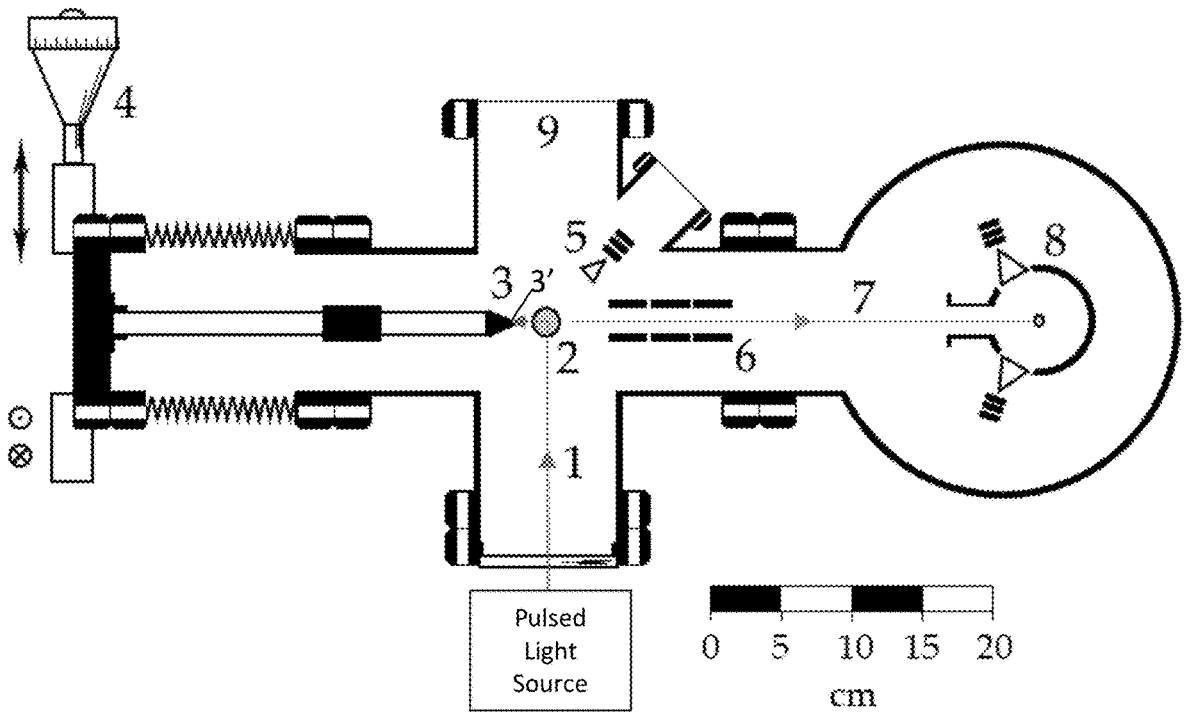
FIG. 5 shows a schematic of a spin-polarized electron source assembly, according to an embodiment.

FIG. 5 illustrates a spin-polarized electron source according to an embodiment. An excitation light source (see, e.g., FIG. 6 for an example laser excitation source) emits controlled light pulses or laser pulses 1 (hereinafter also "laser 1") that enter the chamber and impinge upon or "hit" a focusing mirror 2, which focuses the laser 1 onto a sample 3. In certain aspects, sample 3 comprises a target material such as GaAs or GaAs doped with Zn or Cd. In certain aspects, the laser pulses 1 are circularly or elliptically polarized. In certain aspects, the target material includes a non-negative electron affinity surface (non-NEA, i.e., a surface that has not been layered with Cs and $O_2$, or otherwise processed, to create a NEA condition at that surface). Typically, the non-NEA is the surface exposed to interaction with the pulsed light source, such as the portion forming an edge, a tip or a cusp.

The sample 3 is mounted on a mechanized XYZ translator 4 that allows the sample 3 (and the tip 3' of sample 3) to be moved transversely in the laser focus. A CEM (channel electron multiplier) 5 is used to monitor electron emission from source 3. Transport optics, including electrostatic lens elements 6, focus emitted electrons 7 toward a detector (e.g., Mott polarimeter) 8 in an adjoining analysis chamber. The polarimeter includes two concentric cylindrical electrodes and two CEMs placed symmetrically about the entrance that defines the electron scattering plane. A vacuum pump (e.g., turbomolecular pump) 9 may be mounted to the side of the chamber or elsewhere.

Experimental Examples

To keep the sample as similar to standard polarized electron photocathodes as possible, heavily p-doped bulk GaAs was used. A problem during these experiments was obtaining a high enough emission current to allow measurements of the electron polarization, $P_e$, (~10 pA). When normal surface emission from bulk [110] crystal wafers was studied, there was very little emitted current. When the laser focus was moved to a crystal edge, however, more current was obtained and when focusing on a tip-like area, the emission current increased significantly. Accordingly, sharp structures were then used. Sharp tip-like structures of bulk GaAs may be made by breaking the samples and using an optical microscope to determine the "sharpest" pieces as observed under magnification. When using these sharp tips, typical total emission currents were between 50 pA and 3 nA obtained with an average laser power of ~100 mW. These tips had emission characteristics that were in some ways similar to field emission tips (FETs) typically made of metals like tungsten.

Figure 6:
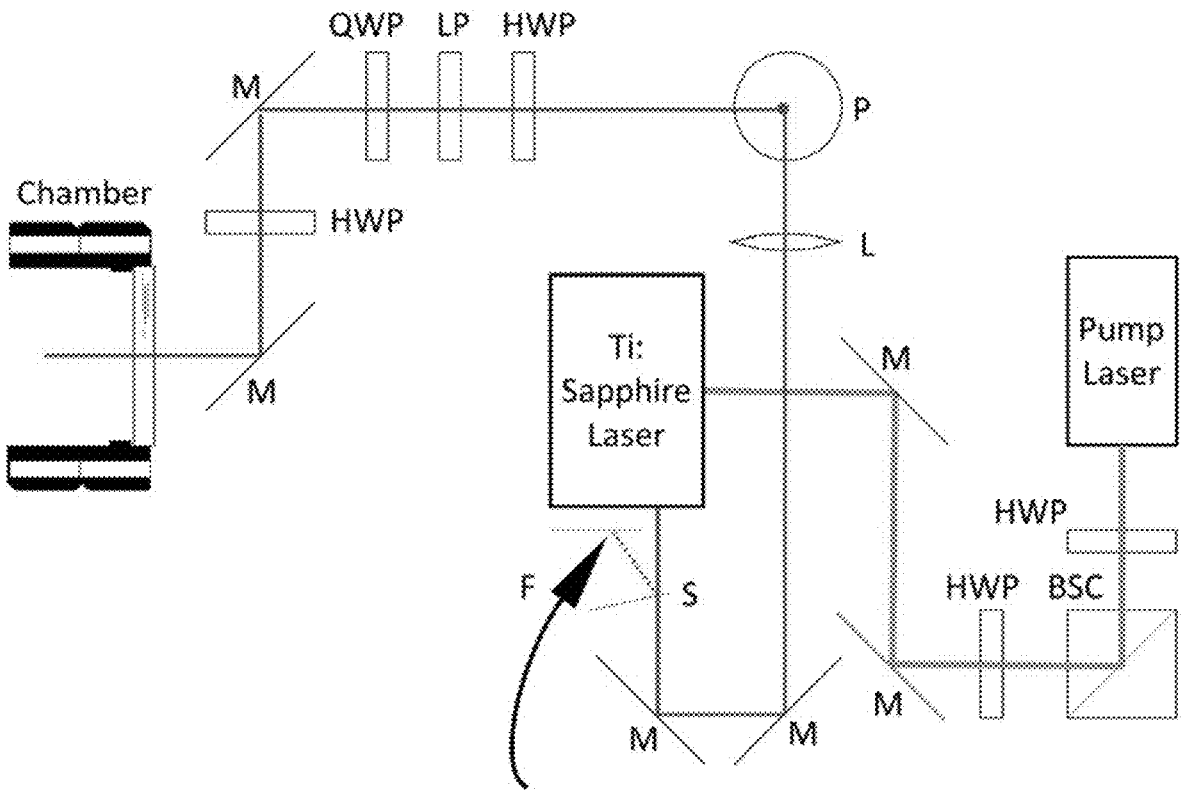
FIG. 6 shows an example of an optical assembly to produce laser pulses, according to an embodiment.

FIG. 6 shows an example of an optical assembly to produce laser pulses (e.g., pulses 1 of FIG. 5), according to an embodiment. The optical assembly includes a Ti: Sapphire laser oscillator (Griffin, KMLabs; e.g., ~785 nm; ~2 nJ/pulse) with an output that passes through a collimating lens and a periscope assembly placed prior to a series of polarizing optics. A half-wave plate (HWP) followed by a linear polarizer (LP) are used to vary the power of the laser without changing the direction of its linear polarization. The beam then passes through a quarter-wave plate (QWP) to change its polarization between linear, left-, and right-handed circular polarization. A final half-wave plate is used to rotate the plane of polarization of linearly-polarized beams. The laser then enters the vacuum chamber through a window. Just before entering the chamber, the temporal width of the laser pulses was measured to be 75 fs with a GRENOUILLE (Swamp Optics) utilizing Frequency Resolved Optical Gating (FROG).

The vacuum chamber includes two sections (see, e.g., FIG. 5). The first section is the source chamber that contains an off-axis front-surface Au parabolic mirror (e.g., mirror 2, FIG. 5) that changes the direction and focusing of the laser. The sample is mounted on a holder attached to an XYZ-translator that allows it to be moved to put the desired section in the laser focus. A channel electron multiplier (CEM) is located near the sample and mirror to monitor the emission current to determine when the sample is optimally placed in the laser focus. The total emission current from the electrically-isolated sample may be measured with a picoammeter. Electrostatic optical elements are used to guide emitted electrons toward the analysis section.

The analysis section of the chamber contains a compact, cylindrical Mott electron polarimeter that has previously been described (N. B. Clayburn, E. Brunkow, S. J. Burtwistle, G. H. Rutherford, T. J. Gay, Rev. Sci. Instrum. 87, 053302 (2016).). The polarimeter includes two concentric cylindrical electrodes and two CEMs placed symmetrically about the entrance that defines the electron scattering plane. The central electrode is plated with gold and was placed at +20 kV, whereas the outer electrode and the mouths of the CEMs were kept at +500 V. To measure the electron polarization, $P_e$, the count rates measured by the left- and right-hand CEMs ($R_L$ and $R_R$) are monitored for electrons produced with light pulses that are right-hand circularly polarized, and then compared with the same rates when the light polarization is flipped:

$$P_e = S_{eff} A, \tag{1}$$

$$\text{where } A = (X-1)/(X+1), \text{ and} \tag{2}$$

$$X = \sqrt{((R_L R'_R)/(R'_L R_R))}. \tag{3}$$

Here $S_{eff}$, the "effective Sherman function," is the analyzing power of the Mott polarimeter, A is the experimental asymmetry, and the primes indicate the CEM rates for left-handed incident laser light. The advantage of measuring the experimental asymmetry this way is that it eliminates first-order instrumental asymmetries associated with geometric imperfections, the optical spin—flipping of the electron polarization, and possible variations in the detection efficiencies of the two CEMs.

Results

Electron polarization measurements were taken for two laser focal positions on the sample. In the first, the 20 μm-diameter focal spot was centered on the tip. In the second, the focus center was moved about 15 μm away from the tip along its axis of symmetry. In this position, the focal waist still substantially overlapped the two tip edges. Before the full set of measurements could be completed on the first sample, it broke. To complete the full set of measurements and to check if this polarization result was reproducible, two more samples were installed and put through the same measurements.

All measurements of $P_e$ are shown in Table 1, below. In the first "tip" position, the electron polarization was ~13% for samples 1 and 2, and ~10% for the third sample when the laser was circularly polarized. When comparing the second and third samples in an SEM, it was found that the second sample had small, sharp features at the position of the laser focus whereas the third sample did not. It is believed that this difference in tip sharpness may be the reason for the differences in $P_e$ between the second and third samples.

TABLE 1

| Target | Light Polarization | Electron Polarization (%) | Dichroism (%) |
|---|---|---|---|
| #1 tip | Circular | 13.1(9) | |
| #2 tip | Circular | 13.3(7) | 4.7(6) |
| | Linear | 0.1(5) | 41.3(1.0) |
| #3 tip | Circular | 10.4(2) | 1.8(2) |
| | Linear | 2.6(2.5) | 18.5(6) |
| #1 shank | Circular | 1.7(8.0) | 6.4(1.4) |
| | Linear | 1.0(2.1) | 23.7(5) |
| #2 shank | Circular | 3.4(1.6) | |
| | Linear | 5.2(1.0) | |

When the laser is linearly polarized, the results are consistent with zero, as expected. In the second "shank" position, the measurements of $P_e$ taken on tip 1, with both incident linearly- and circularly-polarized light, were consistent with zero. With tip 2, $P_e$ was more than two standard deviations away from zero, but with relatively small values.

Measurements of the linear and circular emission dichroism were also made to ensure that the polarization measurements were not being skewed by problems related to power differences of the beam for separate light polarizations. The dichroism, calculated using total emission as measured by the upstream CEM monitor, is defined as $$D=(R1-R2)/(R1+R2),$$

where R1 and R2 are the rates of emission for horizontal and vertical linear polarizations, respectively, when calculating the linear dichroism, and right- and left-handed circular polarization when calculating the circular dichroism. These dichroism measurements were taken at both focal positions and are also given in Table 1. When looking at the tip of the GaAs, the circular dichroism is small (<5%) and the linear dichroism for tips 1 and 2 are 41% and 19%, respectively. There are no reports of emission rates that are dependent upon light helicity in standard GaAs sources. The small non-zero circular dichroism can be explained by slight differences (<1%) in the helicity-dependent power in the laser. Such differences do not affect the measurements of $P_e$ since the polarization is calculated using a ratio of the products of the detector count rates for the two different circular polarizations.

The linear dichroism is also expected as the tip of the GaAs acts like an FET as mentioned earlier. Emission from FETs is much higher when the linear polarization of the light is parallel to the axis of the tip. Dichroism measurements when the shank was in the focus are substantially the same for circularly-polarized light. Linear dichroism measured for tip 1 drops to 24% at the shank, presumably because there is less of a tip-like structure with which the light interacts.

To study how fast electron emission from these samples is, an interferometer was set up to investigate the emission additivity. Additivity is checked by comparing the emission when both beams are incident on a sample to the sum of the emission of each individual beam. If these two values are equal, the emission process is "additive" and thus fast. If more emission occurs with both beams incident than the sum of the emission of each beam individually, it is called "super-additive" and indicates a slow (e.g., thermal) process. The electron emission of the tip is additive and indicates a fast process.

Accordingly, a source has been developed that is able to produce fast pulses of polarized electrons and that enables experiments to measure spin-dependent effects with femtosecond resolution. The much less stringent vacuum requirements of this source when compared with NEA GaAs sources also allow it to be used in experiments with a wide variety of target materials that have previously not been viable due to their deleterious interaction with the surface conditions of the NEA photocathode. The relative ease of operation and the robustness of the source also hold the promise of hastening the spread of polarized electron technology.

It is expected that the polarization can be increased by using a sharper, more well-defined tip. Through the use of ion milling and/or wet etchings it is possible to choose or design the sharpness of the tip. For example, sharper tips (e.g., on the order of 100 nm or smaller) should provide for more coherent emissions.

In certain embodiments, an array of tips may be produced and used to produce more intense emissions. For example, in an embodiment, a GaAs substrate may be etched using a photolithographic mask to produce a rectilinear array (e.g., 2 μm×2 μm) of tips or cusps protruding from the substrate. Excitation of multiple tips or cusps simultaneously using a pulsed source will provide higher intensity emissions due to the multiple emission points.

In certain aspects, a tip or cusp structure has a needle-like or pyramidal-like shape, with a minimum dimension at the tip being on the order of about 10 to about 100 nm, e.g., an average diameter on the order of 10 nm or greater.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the disclosed subject matter (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or example language (e.g., "such as") provided herein, is intended merely to better illuminate the disclosed subject matter and does not pose a limitation on the scope of the invention unless otherwise claimed. No language in the specification should be construed as indicating any non-claimed element as essential to the practice of the invention.

Certain embodiments are described herein. Variations of those embodiments may become apparent to those of ordinary skill in the art upon reading the foregoing description. The inventors expect skilled artisans to employ such variations as appropriate, and the inventors intend for the embodiments to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. A source of fast spin-polarized electrons, comprising:

a target material comprising a sharp tip or a sharp edge or a cusp, the sharp tip of the target material comprising at least two intersecting edges, wherein the target material comprises a material selected from the group consisting of a III-V material and a II-VI material; and a pulsed light source configured to emit light pulses focused on the sharp tip or the sharp edge or the cusp of the target material to thereby induce emission of spin-polarized electrons from the sharp tip or the sharp edge or the cusp of the target material, wherein the emission of spin-polarized electrons comprises spin-polarized electron pulses having a temporal duration comparable to a temporal duration of the light pulses and a temporal width comparable to a temporal width of the light pulses.

2. The source of fast spin-polarized electrons according to claim 1, wherein the target material comprises GaAs.

3. The source of fast spin-polarized electrons according to claim 1, wherein the target material comprises ZnSe, or GaAsP, or GaAs doped with Zn or Cd.

4. The source of fast spin-polarized electrons according to claim 1, wherein the pulsed light source comprises a pulsed laser.

5. The source of fast spin-polarized electrons according to claim 1, wherein the pulsed light source comprises a pulsed laser that emits laser pulses each having a duration of between about 10 fs and about 0.1 ps.

6. The source of fast spin-polarized electrons according to claim 1, wherein the pulsed light source comprises a pulsed laser that emits laser pulses having a wavelength of between about 750 nm to about 850 nm or lower.

7. The source of fast spin-polarized electrons according to claim 6, wherein each of said laser pulses has a wavelength of about 800 nm.

8. The source of fast spin-polarized electrons according to claim 1, wherein the spin-polarized electron pulses comprise pulses having a duration of between about 10 fs and about 0.1 ps.

9. The source of fast spin-polarized electrons according to claim 8, wherein the spin-polarized electron pulses comprise pulses having a duration of about 350 fs.

10. The source of fast spin-polarized electrons according to claim 1, wherein the target material includes a non-negative electron affinity surface.

11. A method of generating fast spin-polarized electrons, the method comprising:

providing a target material comprising a sharp tip or a sharp edge or a cusp, the sharp tip of the target material comprising at least two intersecting edges, wherein the target material comprises a material selected from the group consisting of a III-V material and a II-VI material; and focusing pulses of light from a pulsed light source on the sharp tip or the sharp edge or the cusp of the target material, thereby inducing emission of spin-polarized electrons from the sharp tip or the sharp edge or the cusp of the target material, wherein the emission of spin-polarized electrons comprises spin-polarized electron pulses having a temporal duration comparable to a temporal duration of the pulses of light and a temporal width comparable to a temporal width of the pulses of light.

12. The method of claim 11, wherein the target material comprises GaAs.

13. The method of claim 11, wherein the target material comprises ZnSe, or GaAsP or GaAs doped with Zn or Cd.

14. The method of claim 11, wherein the pulsed light source comprises a pulsed laser.

15. The method of claim 11, wherein the pulsed light source comprises a pulsed laser that emits laser pulses each having a duration of between about 10 fs and about 0.1 ps.

16. The method of claim 15, wherein the pulsed light source comprises a pulsed laser that emits laser pulses each having a duration of between about 50 fs and about 100 fs.

17. The method of claim 11, wherein the pulsed light source comprises a pulsed laser that emits laser pulses having a wavelength of between about 750 nm and about 850 nm or lower.

18. The method of claim 17, wherein each of said laser pulses has a wavelength of about 800 nm.

19. The method of claim 11, wherein the spin-polarized electrons comprises electron pulses comprise pulses of spin-polarized electrons each having a duration of between about 10 fs and about 0.1 ps.

20. The method of claim 19, wherein the pulses of spin-polarized electrons comprise pulses having a duration of between about 50 fs to about 100 fs.

21. The method of claim 19, wherein the pulsed light source comprises a pulsed laser that emits polarized laser pulses.

22. The method of claim 21, wherein the polarized laser pulses are circularly or elliptically polarized.

23. A source of fast spin-polarized electrons, comprising:

a substrate including a plurality of sharp tips or cusps comprising a target material, each of the plurality of sharp tips comprising at least two intersecting edges, wherein the target material comprises a material selected from the group consisting of a III-V material and a II-VI material; and a pulsed light source configured to emit light pulses focused on the plurality of sharp tips or cusps of the target material to thereby induce emission of spin-polarized electrons from the plurality of sharp tips or cusps, wherein the emission of spin-polarized electrons comprises pulses each having a temporal duration comparable to a temporal duration of the light pulses and a temporal width comparable to a temporal width of the light pulses.

24. The source of claim 23, wherein the plurality of sharp tips or cusps are arranged in a rectilinear array.

25. The source of claim 23, wherein the target material comprises GaAs, or ZnSe, or GaAsP, or GaAs doped with Zn or Cd.

26. A method of generating fast spin-polarized electrons, the method comprising:

providing a substrate including a plurality of sharp tips or cusps comprising a target material, each of the plurality of sharp tips comprising at least two intersecting edges, wherein the target material comprises a material selected from the group consisting of a III-V material and a II-VI material; and focusing pulses of light from a pulsed light source on the plurality of sharp tips or cusps, thereby inducing emission of spin-polarized electrons from the plurality of sharp tips or cusps, wherein the emission of spin-polarized electrons comprises spin-polarized electron pulses having a temporal duration comparable to a temporal duration of the pulses of light and a temporal width comparable to a temporal width of the pulses of light.

27. The method of claim 26, wherein the plurality of sharp tips or cusps are arranged in a rectilinear array.

28. The source of claim 26, wherein the target material comprises GaAs, or ZnSe, or GaAsP, or GaAs doped with Zn or Cd.

* * * * *